US007688165B2

(12) United States Patent
Serban

(10) Patent No.: US 7,688,165 B2
(45) Date of Patent: Mar. 30, 2010

(54) GALVANIC ISOLATION MECHANISM FOR A PLANAR CIRCUIT

(75) Inventor: Gabriel Serban, North York (CA)

(73) Assignee: Siemens Milltronics Process Instruments, Inc., Peterborough (CA)

( * ) Notice: Subject to any disclaimer, the term of this patent is extended or adjusted under 35 U.S.C. 154(b) by 0 days.

(21) Appl. No.: 12/464,142

(22) Filed: May 12, 2009

(65) Prior Publication Data

US 2009/0224859 A1 Sep. 10, 2009

Related U.S. Application Data

(63) Continuation of application No. 11/529,458, filed on Sep. 28, 2006, now Pat. No. 7,545,243.

(30) Foreign Application Priority Data

Sep. 28, 2005 (EP) ..... 05021186

(51) Int. Cl.
*H01P 5/08* (2006.01)

(52) U.S. Cl. ..... 333/260; 333/33

(58) Field of Classification Search ..... 333/33, 333/246, 238, 260

See application file for complete search history.

(56) References Cited

U.S. PATENT DOCUMENTS 5,227,749 A 7/1993 Raguenet et al.
5,570,068 A 10/1996 Quan
5,583,468 A 12/1996 Kielmeyer et al.

FOREIGN PATENT DOCUMENTS

| | | | |
|---|---|---|---|
| DE | 195 19 724 | C1 | 8/1996 |
| DE | 103 45 218 | B3 | 12/2004 |
| EP | 1 363 350 | A1 | 11/2003 |
| JP | 2000068715 | A | 3/2000 |

OTHER PUBLICATIONS

Jean-Pierre Raskin, Gildas Gauthier, Linda P. Katehi and Gabriel M. Rebeiz; "Mode Conversion at GCPW-to-Microstrip-Line Transitions"; IEEE Transactions on Microwave Theory and Techniques, Jan. 2000, vol. 48, No. 1; pp. 158-161.

*Primary Examiner*—Stephen E Jones

(57) ABSTRACT

A mechanism is provided for coupling a coaxial cable to a planar circuit to provide galvanic isolation between the coaxial cable and the planar circuit while providing low transmission loss and reflections between the coaxial cable and the circuit. The mechanism comprises a co-planar waveguide coupled to the coaxial cable, a microstrip line connected to the circuit, a galvanic isolation component and a ground plane. The co-planar waveguide, the microstrip line and the galvanic isolation component are formed on one side of a two-sided substrate. The ground plane is formed on the other side of the substrate and underlies at least a portion of the co-planar waveguide to form a grounded co-planar waveguide. The ground plane includes a notch underlying a portion of the co-planar waveguide to provide a transition region from the co-planar waveguide to the grounded co-planar waveguide.

7 Claims, 5 Drawing Sheets

GALVANIC ISOLATION MECHANISM FOR A PLANAR CIRCUIT

CROSS REFERENCE TO RELATED APPLICATIONS

This application is a continuation of Ser. No. 11/529,458 filed on Sep. 28, 2006, now U.S. Pat. No. 7,545,243 which is incorporated by reference herein in its entirety. This application claims priority of European application No. 05021186.1 EP filed Sep. 28, 2005, which is incorporated by reference herein in its entirety

FIELD OF THE INVENTION

The present invention relates to a galvanic isolation mechanism for a planar circuit. Galvanic isolation is an important design element for radar-based level measurement systems, especially for coupling a waveguide to a circuit.

BACKGROUND OF THE INVENTION

Time of flight ranging systems find use in level measurements applications, and are referred to as level measurement systems. Level measurement systems determine the distance to a reflective surface (i.e. reflector) by measuring how long after transmission energy, an echo is received. Such systems may utilize ultrasonic pulses, pulse radar signals, electromagnetic waves, or other microwave energy signals.

Radar and microwave-based level measurement systems are typically preferred in applications where the atmosphere in a container or vessel is subject to large temperature changes, high humidity, dust and other types of conditions which can affect propagation. To provide a sufficient receive response, a high gain antenna is typically used. High gain usually translates into a large antenna size with respect to the wavelength.

Two types of antenna designs are typically found in microwave-based level measurement systems: rod antennas and horn antennas. Rod antennas have a narrow and elongated configuration and are suitable for containers having small opening/flange sizes and sufficient height for accommodating larger rod antennas. Horn antennas, on the other hand, are wider and shorter than rod antennas. Horn antennas are typically used in installations with space limitations, for example, vessels or containers which are shallow.

The level measurement instrument or device comprises a housing and an antenna. The level measurement instrument is mounted on top of the container or vessel and the antenna extends into the vessel. The level measurement instrument is typically bolted to a flange around the opening of the container, i.e. the process connection, and attached to the process connection are the antenna and the housing. The housing holds the electronic circuitry. The antenna extends into the interior of the vessel and is connected to a coupler which is affixed to the housing. The antenna is electrically coupled to the electronic circuit through a coaxial cable. The coaxial cable has one terminal connected to the antenna coupler and the other terminal is connected to a bidirectional or input/output port for the electronic circuit. The antenna converts guided waves into free radiated waves, and is reciprocal, i.e. also converts the free radiated waves into guided waves. The antenna is excited by electromagnetic (i.e. radio frequency) waves or energy or microwave signals received through the coaxial cable from the circuit and transmits electromagnetic waves or energy into the vessel. The antenna couples the electromagnetic waves that are reflected by the surface of the material contained in the vessel and these waves are converted into guided electromagnetic signals which are guided by the coaxial cable (i.e. waveguide) to the circuit.

For safety reasons, for example, intrinsic safety requirements under the EN50020 standard, the radar level measurement devices are required to provide galvanic or DC isolation between the measured process (i.e. the vessel and material interface) and the electronic circuitry in the device. Because the antenna is in contact with the process, the requirement for galvanic isolation is applied between the cable powering the antenna and the electronic circuitry.

In the art, galvanic isolation is an important design element for level measurement apparatus. To be effective, galvanic isolation mechanisms must provide the required isolation, i.e. DC blocking, while minimizing transmission losses and/or reflections. Accordingly, there remains a need for improvements in galvanic isolation mechanisms.

BRIEF SUMMARY OF THE INVENTION

The present invention provides a galvanic isolation mechanism and techniques for a planer circuit as defined in the claims.

Preferred embodiments of the mechanism according to the invention are specified in the remaining claims.

In a first aspect, the present invention provides a galvanic isolation mechanism for a planar circuit, the planar circuit is formed on a two-sided substrate, the galvanic isolation mechanism comprises: a process line, the process line is formed on one side of the substrate; a circuit line, the circuit line is formed on the same side of the substrate as the process line; a DC isolation component, the DC isolation component is formed on the same side of the substrate as the process line, the DC isolation component is coupled to one end of the process line and to one end of the circuit line, the DC isolation component provides a block for DC signals between the process line and the circuit line; a ground plane, the ground plane is formed on the other side of the substrate, the ground plane underlies at least a portion of the process line and the circuit line.

In another aspect, the present invention provides a galvanic isolation mechanism for a planar microwave circuit formed on a two-sided substrate, the galvanic isolation mechanism comprises: a coplanar waveguide, the coplanar waveguide is formed on one side of the substrate, and includes a connector for connecting to a coaxial cable from an external process; a microstrip line, the microstrip line is formed on the same side of the substrate as the coplanar waveguide, and the microstrip line provides a port between the external process and the planar microwave circuit; a microwave DC block, the microwave DC block comprises a microstrip structure formed on the same side of the substrate as the coplanar waveguide, one end of the coplanar waveguide is coupled to the microwave DC block, and one end of the microstrip line is coupled to the microwave DC block, and the microwave DC block operates to pass AC microwaves signals between the coplanar waveguide and the microstrip line and block DC voltage; a ground plane, the ground plane is formed on the other side of the substrate, the ground plane underlies at least a portion of the coplanar waveguide and the microstrip line.

In yet another aspect, the present invention provides a galvanic isolation mechanism formed on a two-sided substrate, the galvanic isolation mechanism comprises: a co-planar waveguide, the co-planar waveguide is formed on one side of the substrate; a DC blocking component, the DC blocking component is formed on the same side of the substrate as the co-planar waveguide; a microstrip line, the microstrip line is formed on the same side of the substrate as the co-planar waveguide; a ground plane, the ground plane is formed on the other side of the substrate and the ground plane underlies a portion of the co-planar waveguide to form a grounded co-planar waveguide; and the grounded co-planar waveguide is coupled to the microstrip line through the DC blocking component, and the DC blocking component blocks DC signals and allows AC signals between the grounded co-planar waveguide and the microstrip line.

Other aspects and features of the present invention will become apparent to those ordinarily skilled in the art upon review of the following description of specific embodiments of the invention in conjunction with the accompanying drawings.

BRIEF DESCRIPTION OF THE DRAWINGS

Reference is now made to the accompanying drawings which show, by way of example, embodiments of the present invention and in which.

In the drawings, like references or characters indicate like elements or components.

DETAILED DESCRIPTION OF EMBODIMENTS OF THE INVENTION

Figure 1:
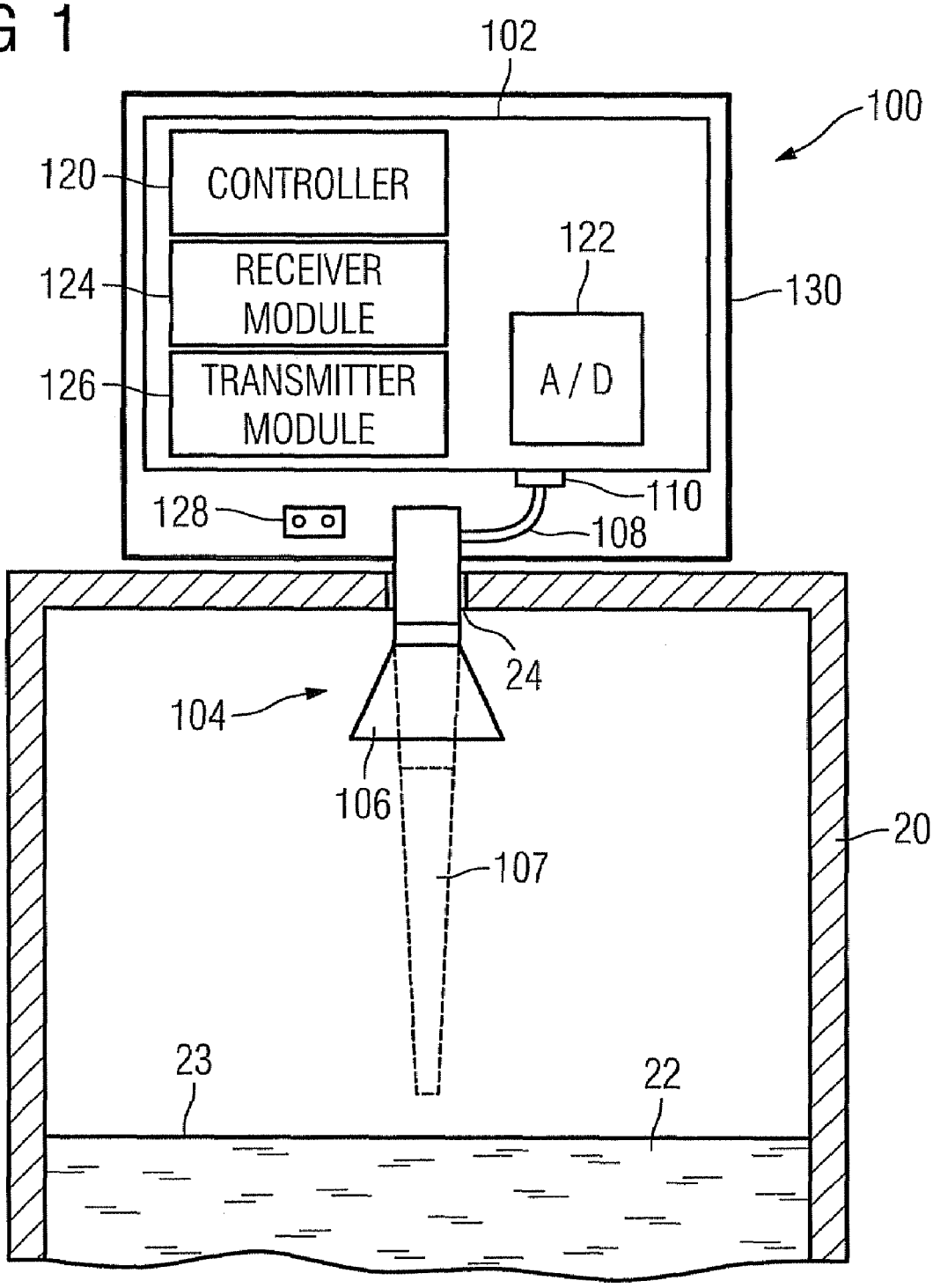
FIG. 1 shows in diagrammatic form a radar-based level measurement system with an antenna coupling mechanism according to the present invention.

Reference is first made to FIG. 1 which shows in diagrammatic form a radar-based or a microwave-based level measurement apparatus 100 incorporating a galvanic isolation mechanism in accordance with the present invention.

As shown in FIG. 1, the level measurement apparatus 100 comprises a controller module 102 and an antenna assembly or module 104. The antenna assembly 104 is mounted on top of a container or vessel 20 (i.e. the process connection), and the vessel 20 holds a material 22, e.g. liquid, slurry or solid. The controller module 102 is contained in a housing 130 which is connected to the antenna assembly 104. The level measurement apparatus 100 functions to determine the level of the material 22 held in the vessel 20. The level of the material 20 is defined by a top surface, and denoted by reference 23, which provides a reflective surface for reflecting electromagnetic waves or energy. The vessel or container 20 has an opening 24 and the antenna assembly 104 is attached or clamped to the opening 24 using techniques as will be familiar to those skilled in the art.

The controller module 102 houses the electronic circuitry and is coupled to the antenna assembly 104 by a coaxial cable 108 or other suitable waveguide component. The antenna assembly 104 extends into the interior of the vessel 20 and comprises an antenna or waveguide 106. The antenna or waveguide 106 comprises a horn antenna structure as shown in FIG. 1. According to another embodiment, the antenna may comprise a rod antenna arrangement 107 as shown in broken outline in FIG. 1. The controller module 102 includes a connector 110 for the connecting to the coaxial cable 108 and the coaxial cable 108/connector 110 is coupled to a galvanic isolation board indicated generally by reference 200 in FIG. 2. As will be described in more detail below, the galvanic isolation board 200 couples the antenna assembly 104 to the electronic circuitry, for example, a microstrip or MS line in a planar microwave circuit, while providing galvanic or DC isolation. Galvanic isolation means that both the signal lines and the ground planes are galvanically isolated.

The electronic circuitry in the level measurement apparatus 100 includes a number of circuit modules comprising a controller 120 (for example a microcontroller or microprocessor operated under stored program control), an analog-to-digital converter module 122, a receiver module 124 and a transmitter module 126. The circuitry in the controller module 102 may also include a current loop interface (4-20 mA) indicated by reference 128. The antenna 106 is coupled to the controller 120 through the transmitter module 126 and the receiver module 124. The galvanic isolation board 200 provides the physical, i.e. electrical, connection between the antenna 106 and the transmitter module 126 and the receiver module 124. The receiver 124 and the transmitter 126 modules are typically fabricated on a substrate as a planar microwave circuit. The controller 120 uses the transmitter module 126 to excite the antenna 106 with electromagnetic energy in the form of pulsed electromagnetic signals or continuous radar waves. The electromagnetic energy, i.e. guided radio frequency waves, are transmitted to the antenna 106 through the coaxial cable 108 coupled to the antenna assembly 104. The antenna 106 converts the guided waves into free radiating waves which are emitted by the antenna 106 and propagate in the vessel 20. The electromagnetic energy, i.e. reflected free radiating waves, reflected by the surface 23 of the material 22 contained in the vessel 20 is coupled by the antenna 106 and converted into guided electromagnetic signals which are transmitted by the coaxial cable 108 through the galvanic isolation interface 200 (FIG. 2) and back to the receiver module 124. The electromagnetic signals received through the galvanic isolation interface 200 (FIG. 2) are processed and then sampled and digitized by the A/D converter module 122 for further processing by the controller 120. The controller 120 executes an algorithm which identifies and verifies the received signals and calculates the range of the reflective surface 23, i.e. based on the time it takes for the reflected pulse (i.e. wave) to travel from the reflective surface 23 back to the antenna 106. From this calculation, the distance to the surface 23 of the material 22 and thereby the level of the material, e.g. liquid 22 in the vessel 20, is determined. The controller 120 also controls the transmission of data and control signals through the current loop interface 128. The controller 120 is typically implemented using a microprocessor-based architecture and the microprocessor which is suitably programmed to perform these operations as will be within the understanding of those skilled in the art. These techniques are described in prior patents of which U.S. Pat. No. 4,831,565 and U.S. Pat. No. 5,267,219 are exemplary.

The antenna assembly 106 functions as a waveguide in conjunction with the transmitter 126 and the receiver 124 modules. The antenna assembly 106 transmits electromagnetic signals (i.e. free radiating waves) onto the surface 23 of the material 22 in the vessel 20. The electromagnetic waves are reflected by the surface 23 of the material 22, and an echo signal is received by the antenna assembly 106. The echo signal is processed using known techniques, for example, as described above, to calculate the level of the material 22 in the vessel 20.

Figure 2:
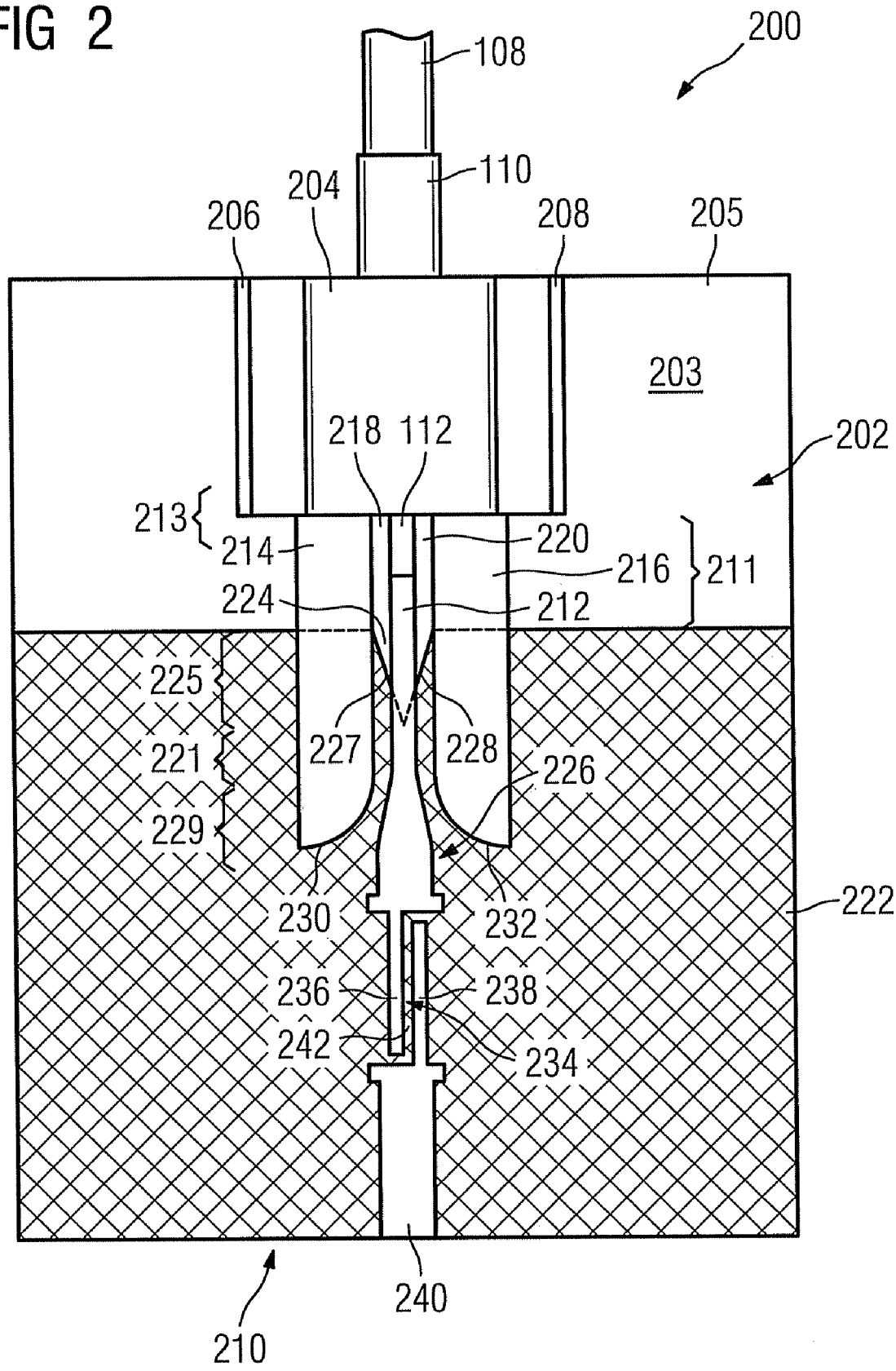
FIG. 2 shows a galvanically isolated coupler mechanism according to one embodiment of the present invention.

Reference is made to FIG. 2, which shows in more detail a first embodiment of the galvanic isolation interface or mechanism 200 in accordance with the present invention. As shown in FIG. 2, the galvanic isolation interface 200 comprises a substrate or carrier member indicated by reference 202 and a connector 204. The substrate 202 comprises a two-sided printed circuit board or other suitable carrier. One side (e.g. the top surface) is indicated by reference 203 and the other side (e.g. bottom surface) is indicated by reference 205 in FIG. 2. The microwave circuit, e.g. the receiver 124 and the transmitter 126 modules, are formed on the substrate 202 as a planar circuit indicated generally by reference 210. The substrate 202 has a controlled thickness and dielectric constant, and exhibits low losses at microwave frequencies.

The planar microwave circuit 210 (i.e. the receiver 124 and the transmitter 126 modules) form the 'front-end' of the electronic circuitry for the level measurement device 100. The planar microwave circuit 210 can be realized using various technologies such as microstrip lines. A microstrip circuit is realized on a substrate material having a controlled thickness and dielectric constant. For a microstrip circuit implementation, one side of the substrate 202, for example, the lower side 205, is metalized and the metalized area provides a ground plane. On the other side of the substrate 202, for the top side 203, microstrip lines are formed as traces or tracks of copper on the surface. The width of the trace determines the impedance of the microstrip line for the microwave signals. Impedance is constant when the width of the microstrip line is constant. A microwave signal propagates without losses and reflections when the impedance of the microstrip is constant. If the impedance cannot be kept constant, then matching is required. Matching involves changing, in a controlled manner, the width or shape of the microstrip line(s) at various points along the planar circuit.

Referring to FIG. 2, the coaxial cable 108 includes the connector 110. The connector 110 is soldered or otherwise affixed to the end of the coaxial cable 108 and physically couples the coaxial cable 108 to the controller module 102 (FIG. 1) and electrically connects the coaxial cable 108 to the circuit. The coaxial cable 108 has a center conductor, indicated by reference 112 in FIG. 2, which extends through the connector 110 and is electrically coupled to the planar microwave circuit 210 as described in more detail below. The connector 110 on the coaxial cable 108 connects to the connector 204. The connector 204 is a mating connector which is soldered on the substrate 202. The connectors 110 and 204 comprise suitable microwave type connectors, for example, SMA, SMP, MCX, MMCX, K or V type devices as will be familiar to those skilled in the art.

The connector 204 for planar microwave circuit 210 mounted on the substrate 202 comprises a "surface mount edge" type component or a "surface mount right angle" component. Alternatively, the coaxial cable 108 may be attached directly to the substrate 202 with the inner or center conductor 112 extended. As shown in FIG. 2, the connector 204 is affixed, i.e. soldered, to two patches or strips of copper, indicated by references 206 and 208, respectively. The two copper patches 206, 208 are etched on the surface 203 of the substrate 202. The two copper patches 206, 208 and the body of the connector 204 form a ground plane that references the signal coming through the coaxial cable 108 (i.e. the center conductor 112).

Referring to FIG. 2, the center conductor 112 (and/or the center conductor of the connector 204) of the coaxial cable 108 is affixed or soldered to a microstrip line 212. The microstrip line 212 forms an input port or input line for guiding the signal from the coaxial cable 108 into the microwave circuit 210. As shown, two strips of copper, indicated by references 214 and 216, extend and run parallel from the ground plane formed by the strips 206, 208 and the body of the connector 204. The copper strips 214, 216 are equidistant on each side of the microstrip line 212. The arrangement or structure of the microstrip line 212 and the side copper strips 214, 216 form a co-planar waveguide or CPW line denoted generally by reference 211. The arrangement of the connector 204 (and the coaxial cable 108) followed by the CPW 211 form a coaxial to CPW transition denoted generally by the reference 213. The impedance of the coaxial cable 108 is typically 50 Ohm, but other impedance values are possible, for example, 75 Ohm. The CPW 211 facilitates matching the coaxial cable 108 and the connector 204 as the impedance of the CPW 211 depends on the width of the microstrip line 212 and the slots formed between the microstrip line 212 and the respective copper strips 214 and 216. In FIG. 2, the slots are indicated by references 218 and 220, respectively.

To launch or couple the wave propagating in the coaxial cable 108 and the connector 204 along the CPW line 211 with a minimum of reflections and losses, the width of the microstrip line 212 and the slots 218, 220 and the ground planes formed by the copper strips 214 and 216 have to be appropriately computed. For example, for a 50 Ohm RG405 coaxial cable 108 and a SMP type connector, a width of 0.7 mm for the microstrip line 212 and a width of 0.5 mm for each of the slots 218, 220 provides reflections less than −20 dB. The breakdown voltage between the CPW line 211 and the copper strips (ground planes) 214 and 216 depends on the width of the slots 218, 220. For example, to provide a breakdown voltage of 1 KVDC, the width of each of the slots 218, 220 is approximately 0.5 mm. Accordingly, the widths of the microstrip line 212 and the slots 218, 220 are calculated to optimize the desired microwave transmission characteristics while maintaining a high breakdown voltage.

Referring again to FIG. 2, the bottom or lower surface 205 of the substrate 202 includes a ground plane. The ground plane is indicated by reference 222 and shown as the cross-hatched area in the drawing. A portion of the CPW line 211 extends above the ground plane 222. The CPW line 211 when above the ground plane 222 transforms into a grounded coplanar waveguide or GCPW line indicated generally by reference 221 in FIG. 2. The GCPW line 221 is characterized by a different impedance value, and the area or region of the GCPW line 221 forms a GCPW zone 223. To provide a low reflection/loss transition from the CPW line 211 to the GCPW 221 line, the ground plane 222 on the lower surface 205 of the substrate 202 includes a notch 224 which is shown using a broken outline. The region of the notch 224 forms a transition zone 225 for the CPW line 211 to the GCPW line 221. The other end of the GCPW line 221 is coupled or formed to a microstrip line indicated by reference 226.

The notch 224 as depicted in FIG. 2 has a triangular configuration with straight sides indicated by references 227 and 228. In other embodiments, the sides 227, 228 for the notch 224 may have a shape defined by exponential or polynomial functions. The notch 224 may also comprise a trapezoidal configuration and other shapes or configurations.

The wave propagating along the GCPW line 221 is launched along the microstrip line 226. As shown in FIG. 2, a transition section 228 is formed between the GCPW line 221 and the microstrip line 226. The transition section 228 comprises a strip which gradually increases from the width of the GCPW line 221 to the width of the microstrip line 226. As also shown, the width of slots 218 and 220 between the center conductor of the GCPW line 221 and the side ground planes 214 and 216 increases more rapidly as indicated by references 230 and 232, respectively. The increasing widths 230, 232 of the slots 218, 220 forces the field lines along the GCPW line 221 which would otherwise spread to the side ground planes 214, 216 to be directed to the ground plane 222 on the bottom surface 205 of the substrate 202. This arrangement produces a gradual field structure characteristic to the propagation along the microstrip line 226. The geometrical arrangement of the transition section 228 is configured, i.e. optimized, to provide a low reflection and/or low loss transition, in manner similar to that described above. The width of the GCPW line 221 as well as the widths 230, 232 (i.e. the shape of the ends of the side ground planes 214, 216) of the respective slots 218, 220 may be increased utilizing a linear relationship or function. The respective widths may also be defined or modified utilizing a suitable stepped, exponential or polynomial relationship or function.

Referring again to FIG. 2, the planar microwave circuit 210 includes a microstrip structure comprising a microwave DC block 234. The microwave DC block 234 comprises a microstrip structure 236 formed at the end of the microstrip line 226 and another microstrip structure 238. The strip structure 238 is coupled or formed with a microstrip line 240. The strip 236 is separated from the other microstrip 238 by a gap 242 which provides DC or galvanic isolation. The microstrip line 240 functions as input/output or bidirectional port for electronics comprising the measurement and processing circuitry. The microstrip structure for the DC block 234 provides good microwave transmission properties while maintaining galvanic isolation between the microstrip line 240 and the microstrip line 226. Other galvanic isolation mechanisms or structures may be used, such as, a wideband coupled lines filter(s), an interdigital capacitor(s), or a lumped capacitor(s).

Figure 6:
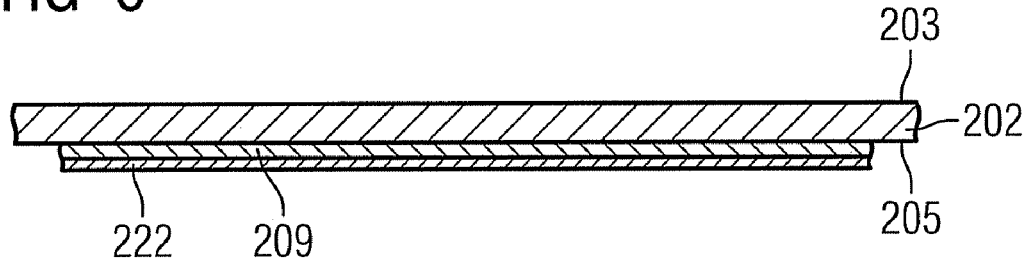
FIG. 6 shows a cross-sectional view of the substrate for the galvanically isolated coupler mechanism of FIG. 2.

According to another aspect, a second layer of dielectric material or a backing layer 209 may be placed on the lower surface 205 between the substrate 202 and the ground plane layer 222 as illustrated in the cross-sectional view of FIG. 6. The purpose of this backing layer 209 is to provide mechanical strength to the substrate 202 and/or provide another layer for building additional circuits. The material for the backing layer 209 does not necessarily need to have or exhibit good microwave properties in the exposed region, i.e. near the coaxial connector 204, because the field is concentrated between the microstrip line 212 and the side ground planes 214 and 216.

Figure 3:
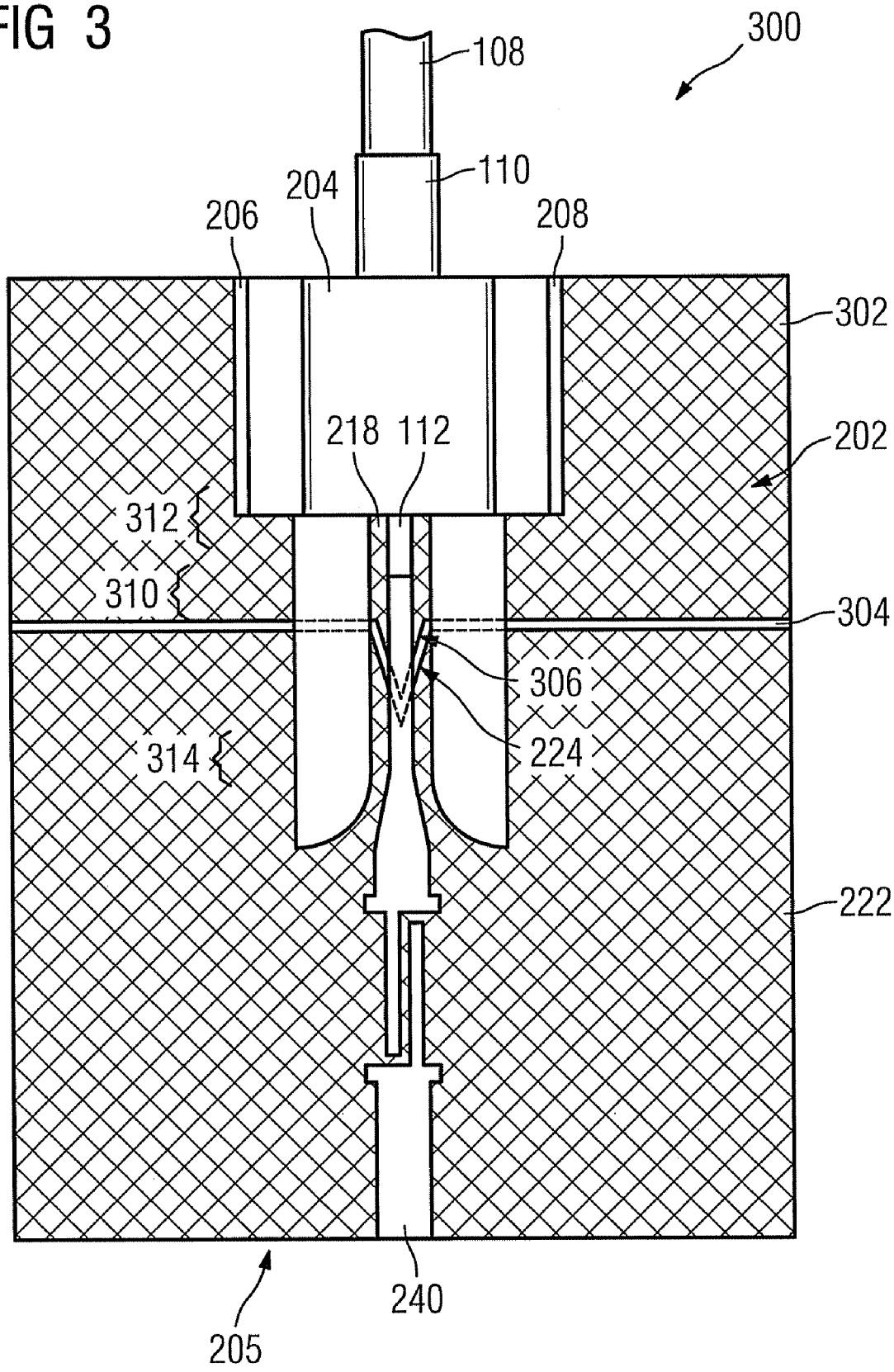
FIG. 3 shows a galvanically isolated coupler mechanism according to a second embodiment of the present invention.

Reference is next made to FIG. 3, which shows a galvanic isolation mechanism according to another embodiment of the present invention and indicated generally by reference 300. The galvanic isolation mechanism 300 is similar to the galvanic isolation mechanism 200 of FIG. 2, and like elements are indicated by like references as shown in the drawings.

As shown in FIG. 3, the galvanic isolation mechanism 300 includes another ground plane 302. The ground plane 302 is formed on the bottom surface 205 of the substrate 202. The ground plane 302 is separated from the ground plane 222 by a gap or slot indicated by reference 304. The ground plane 302 includes a tip or projection 306. The tip 306 substantially matches the shape or configuration of the notch 224 in the ground plane 222 for the microstrip line 212. The shape of the tip 306 is configured to match the shape of the notch 224, and may be triangular with straight sides (as shown) or have sides defined by an exponential or a polynomial function. The shape of the tip 306 may also comprise a trapezoidal shape or configuration.

The slot or gap 304 between the ground planes 222 and 302 comprises a constant distance or width. The width of the gap 304 defines a breakdown voltage value between the ground planes 222 and 302, and changes in the width of the gap 304 will affect the breakdown voltage between the ground planes 222 and 302. The breakdown voltage between the ground planes 222 and 302 may also be increased by providing a second layer, i.e. the backing layer 209 (FIG. 6), of a dielectric material between the ground plane(s) 222 and/or 302 and the bottom surface 205 of the substrate 202. For this purpose, the material for the backing layer 209 will have a high breakdown voltage, but does not necessarily need good microwave transmission characteristics or properties. For example, FR4 is a suitable material for the backing layer 209.

The dimensions and/or shape of the notch 224, the tip 306 and the gap 304 between the ground planes 222 and 302 are optimized for optimal microwave characteristics at the desired working frequency, for example, in the manner as described above.

Referring to FIG. 3, the arrangement of the microstrip line 212 and the side copper strips 214 and 216 form a grounded co-planar waveguide or GCPW line as described above. With the ground plane 302 on the bottom surface 205 of the substrate 202, the grounded co-planar waveguide or GCPW line is formed and indicated by reference 310 in FIG. 3. The arrangement of the connector 204 (and the coaxial cable 108) followed by the GCPW line 310 form a coaxial to GCPW transition denoted generally by reference 312 in FIG. 3. The microstrip line 221 (i.e. below the notch 224) and lying above the ground plane 222 forms a grounded co-planar waveguide GCPW 223 as described above. The gap 304 between the notch 224 and the tip 306 provides an isolation gap and creates an isolated GCPW to GCPW transition as indicated by reference 314. The transition from the GCPW line 310 to the microstrip line 221 is indicated by reference 314 in FIG. 3.

The arrangement of the second ground plane 302 next to the connector 204 provides a grounded co-planar waveguide which improves the characteristics of the transition from the connector 204 to the microstrip line 212. For instance, the GCPW line 310 will have a lower impedance than the CPW line 212 for the same width of the center line and the slots 218, 220 between the center line 212 and the side ground planes 214, 216. This means that for the GCPW line 310, the width of the slots 218, 220 can be increased to further increase the breakdown voltage level between the microstrip line 212 and the side ground planes 214, 216. The ground plane 302 also serves to improve shielding of the microstrip line 212 and the center conductor 112 (i.e. the active line) by reducing radiation from the active line and by also reducing interference from external fields.

Figure 4:
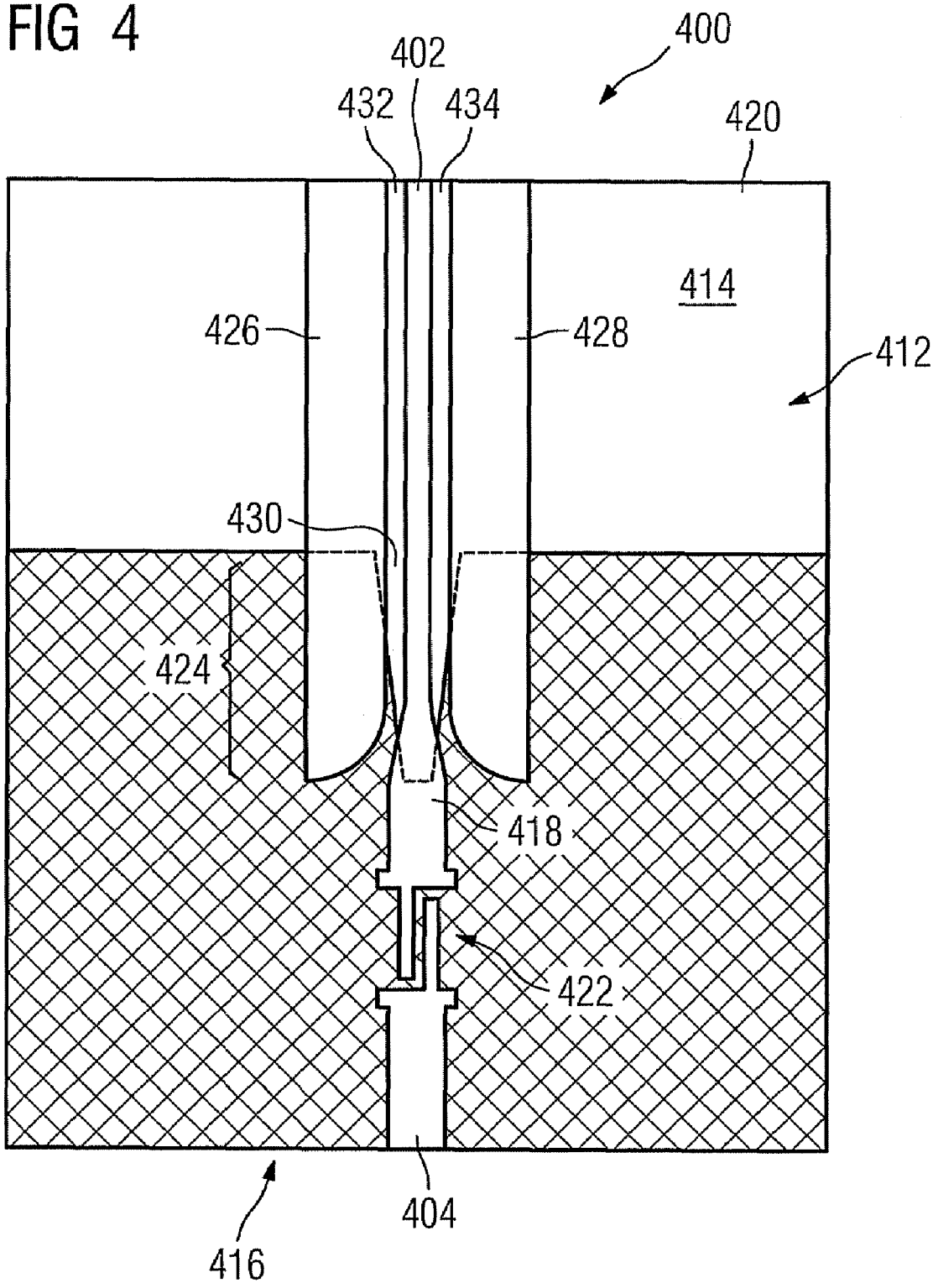
FIG. 4 shows a galvanically isolated coupler mechanism according to a third embodiment of the present invention.

Reference is next made to FIG. 4, which shows a galvanic isolation mechanism according to another aspect of the invention and indicated generally by reference 400. The galvanic isolation mechanism 400 provides a galvanically isolated transition from a coplanar waveguide line 402 to a microstrip line 404. In a manner similar to that described above, a planar circuit 410 is formed on a substrate 412. The substrate 412 comprises a top or upper surface 414 (i.e. a first surface or plane) and a lower or bottom surface 416 (i.e. a second surface or plane). The galvanic isolation mechanism 400 includes a microstrip line 418, a ground plane 420, a microwave DC block 422, a transition section 424, and side ground planes 426 and 428. The microstrip line 418 is coupled to the CPW line 402 through the transition section 424. The microwave DC block 422 provides the galvanic or DC isolation between the microstrip line 418 (and the CPW line 402) and the microstrip line 404. As described above, other devices, such as a wideband coupled lines filter, an interdigital capacitor, or a lumped capacitor, may be used in place of the microwave DC block 422 shown in FIG. 4.

Referring to FIG. 4, the ground plane 420 is formed on the bottom or lower surface 416 of the substrate 412 and underlies the microstrip line 418. In a manner similar to that described above, the ground plane 420 includes a notch 430 to provide a transition region or zone. The side ground planes 426 and 428 are formed on the sides of the CPW line 402 (i.e. the center line) by metallizing the surface 414 with copper or other suitable conductive metal. The side ground planes 426, 428 define respective slots 432 and 434 between the center line and the side ground planes 426, 428. As described above, the widths of the slots 432, 434 define a breakdown voltage level between the center line 402 and the side ground planes 426, 428.

Figure 5:
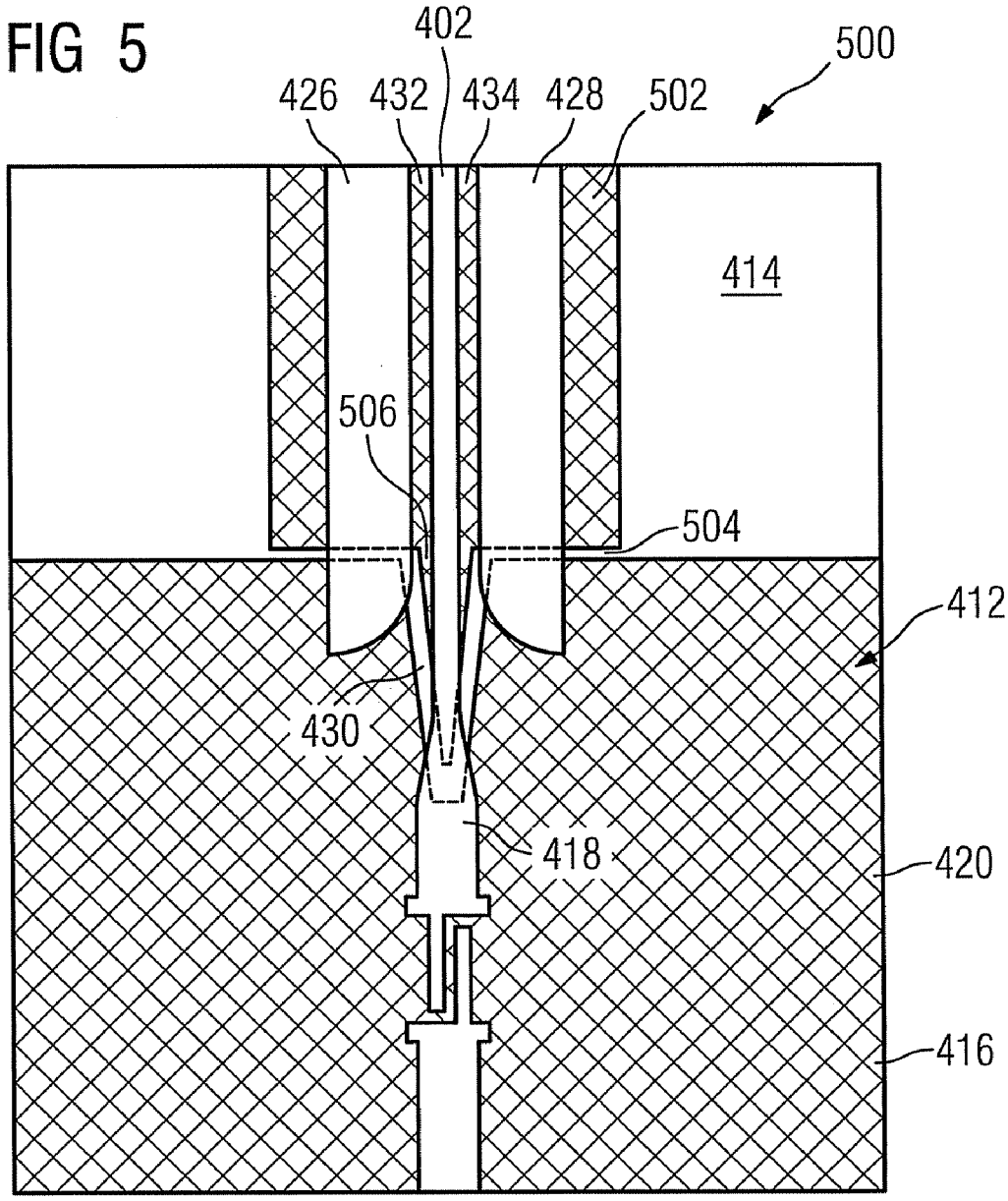
FIG. 5 shows a galvanically isolated coupler mechanism according to another embodiment of the present invention.

Reference is next made to FIG. 5, which shows another embodiment of a galvanic isolation mechanism according to another aspect of the invention and indicated generally by reference 500. The galvanic isolation mechanism 500 is similar to the mechanism 400 described above with reference to FIG. 4. The mechanism 500 provides a galvanically isolated transition from a coplanar waveguide line 402 to a microstrip line 404. Like elements are indicated by like references in FIGS. 4 and 5.

As shown in FIG. 5, the galvanic isolation mechanism 500 includes a second ground plane 502. The second ground plane 502 is formed on the bottom surface 416 of the substrate 412 and underlies all or a portion of the microstrip line 402 (i.e. the center line). The second ground plane 502 is separated from the ground plane 420 by a gap indicated by reference 504. The second ground plane 502 also includes a tip 506. The tip 506 matches the notch 430 in the ground plane 420 for the microstrip line 418. The shape of the tip 506 is configured to match the shape of the notch 430, and as describe above may be triangular with straight sides (as shown) or have sides defined by an exponential function or a polynomial function. The shape of the tip 506 may also comprise a trapezoidal shape or configuration.

The slot or gap 504 between the ground planes 420 and 502 comprises a constant distance or width. As described above, the width of the gap 504 defines a breakdown voltage value between the ground planes 420 and 502, and changes in the width of the gap 504 will affect the breakdown voltage between the ground planes 420 and 502. The breakdown voltage between the ground planes 420 and 502 may also be increased by providing a second layer or backing layer, for instance a layer 209 formed of a dielectric material between the ground plane(s) 420 and/or 502 and the bottom surface 416 of the substrate 412 as described above with reference to FIG. 6. For this purpose, the material for the backing layer will have a high breakdown voltage, but does not necessarily need good microwave transmission characteristics or properties. For example, FR4 is a suitable material for the backing layer.

While the galvanic isolation mechanism and its various embodiments are described in the context of a level measurement apparatus, it will be appreciated that the galvanic isolation mechanism has wider application and is suitable for other applications for coupling a coaxial cable to a microstrip line in a planar circuit to provide galvanic separation with lower transmission losses and reflections of the signal between the coaxial cable and the planar circuit.

The apparatus and techniques according to the present invention also find application in a FMCW radar level transmitter system. FMCW radar level transmitter systems transmit a continuous signal during the measurement process. The frequency of the signal increases or decreases linearly with time so that when the signal has traveled to the reflective surface and back, the received signal is at a different frequency to the transmitted signal. The frequency difference is proportional to the time delay and to the rate at which the transmitted frequency was changing. To determine the distance that the reflector is away from the radar transmitter, it is necessary to analyze the relative change of the received signal with respect to the transmitted signal as will be appreciated by those skilled in the art.

What is claimed is:

1. A galvanic device for a planar circuit, the planar circuit formed on a two-sided substrate, the galvanic isolation mechanism comprising:

a coplanar waveguide formed on a first side of the two-sided substrate and including a center conductor and two side ground planes running parallel and equidistant on each side of the center conductor, the centre conductor ending in a microstrip line;

a first ground plane formed on a second side of the two-sided substrate and underlying the microstrip line and an adjacent portion of the coplanar waveguide, thus transforming the coplanar waveguide into a grounded coplanar waveguide;

a direct current isolation component formed on the first side of the two-sided substrate; and a coaxial cable connector mounted on the first side of the two-sided substrate and connected to the coplanar wave guide, wherein a first terminal of the coaxial cable connector is connected to the two side ground planes and a second terminal of the coaxial cable connector is connected to the center conductor of the coplanar wave guide, wherein the direct current isolation component is arranged between the microstrip line and a further microstrip line formed on the first side of the two-sided substrate, and comprises a strip extending from an end of the microstrip line, with another strip extending from an adjacent end of the further microstrip line, and a gap separating and galvanically isolating said strips from each other, and wherein the two side ground planes of the coplanar waveguide are galvanically isolated from the first ground plane.

2. The galvanic isolation mechanism as claimed in claim 1, further comprising:

a second ground plane formed on the second side of the two-sided substrate, the second ground plane separated from the first ground plane by a gap separating and galvanically isolating the first and second ground planes from each other.

3. The galvanic isolation mechanism as claimed in claim 1, further comprising a dielectric backing layer placed against the second side of the two-sided substrate, between the two-sided substrate and the first ground plate.

4. The galvanic isolation mechanism as claimed in claim 1, wherein the first ground plane includes a notch underlying a section of the coplanar waveguide and forming a transition zone for the coplanar waveguide to the grounded coplanar waveguide.

5. The galvanic isolation mechanism as claimed in claim 4, wherein the coplanar waveguide includes a transition section between the grounded coplanar waveguide and the microstrip line, the side ground planes include shaped end sections adjacent the transition section where a width of slots between the center conductor of the grounded coplanar waveguide and the side ground planes increases.

6. The galvanic isolation mechanism as claimed in claim 4, further comprising:

a second ground plane formed on the second side of the two-sided substrate, the second ground plane separated from the first ground plane by a gap separating and galvanically isolating the first and second ground planes from each other.

7. The galvanic isolation mechanism as claimed in claim 6, wherein the second ground plane includes a tip, the tip having a configuration substantially matching the configuration of the notch.

* * * * *